US006088211A

United States Patent [19]

Pitel

[11] Patent Number: 6,088,211

[45] Date of Patent: Jul. 11, 2000

[54] SAFETY CIRCUITRY FOR ION GENERATOR

[75] Inventor: Ira J. Pitel, Morristown, N.J.

[73] Assignee: Ion Systems, Inc., Berkeley, Calif.

[21] Appl. No.: 09/103,796

[22] Filed: Jun. 24, 1998

Related U.S. Application Data

[63] Continuation-in-part of application No. 08/966,638, Nov. 10, 1997, Pat. No. 5,930,105.

[51] Int. Cl.[7] ..... H05F 3/06

[52] U.S. Cl. ..... 361/212; 361/213

[58] Field of Search ..... 361/212, 213, 361/225, 229, 230, 231, 235; 250/324–326

[56] References Cited

U.S. PATENT DOCUMENTS

| | | | |
|---|---|---|---|
| 3,120,626 | 2/1964 | Schweriner | 317/2 |
| 3,137,806 | 6/1964 | Schweriner | 317/2 |
| 3,156,847 | 11/1964 | Schweriner | 317/4 |
| 3,443,155 | 5/1969 | Schweriner | 317/2 |
| 4,216,518 | 8/1980 | Simons | 361/213 |
| 4,423,462 | 12/1983 | Antonevich | 361/235 |
| 4,542,434 | 9/1985 | Gehlke et al. | 361/213 |
| 4,630,167 | 12/1986 | Huggins | 361/213 |
| 4,689,715 | 8/1987 | Halleck | 361/213 |
| 4,729,057 | 3/1988 | Halleck | 361/213 |
| 4,774,472 | 9/1988 | Blitshteyn et al. | 361/213 |
| 4,775,915 | 10/1988 | Walgrove, III | 361/225 |
| 4,809,127 | 2/1989 | Steinman et al. | 361/213 |
| 4,872,083 | 10/1989 | Blitshteyn | 361/213 |
| 4,951,172 | 8/1990 | Stenman et al. | 361/213 |
| 5,008,594 | 4/1991 | Swanson et al. | 315/111.81 |
| 5,017,876 | 5/1991 | Wright et al. | 324/464 |
| 5,124,905 | 6/1992 | Kniepkamp | 361/235 |
| 5,432,454 | 7/1995 | Durkin | 324/452 |
| 5,930,105 | 6/1999 | Pitel et al. | 361/212 |

*Primary Examiner*—Fritz Fleming
*Attorney, Agent, or Firm*—Fenwick & West LLP

[57] ABSTRACT

A capacitor is serially-connected to apply alternating line signal to ion generators that are normally operable on alternate half cycles of line signal for safely inhibiting further operation of a generator of air ions of one polarity in the event a generator of air ions of opposite polarity incurs circuit malfunction. In an alternative embodiment, serially-connected capacitor are shunted by serially-connected diodes poled for unidirectional conduction in opposite directions, with junctions of capacitors and diodes connected together. Conduction of alternate half cycles of AC line signal conducted through such diode-capacitor network during circuit failure of one of the air ion generators to operate properly on the respective alternate half cycle of the AC line signal causes build up of accumulated charge and voltage across one capacitor with a polarity that significantly reduces the average voltage applied to the other, operational air ion generator during each respective alternate half cycle of AC line signal.

4 Claims, 2 Drawing Sheets

SAFETY CIRCUITRY FOR ION GENERATOR

RELATED APPLICATION

This application is a continuation-in-part application of U.S. Pat. No. 5,930,105 Ser. No. 08/966,638 filed Nov. 10, 1997, entitled "Method and Apparatus for Air Ionization", issued on Jul. 27, 1999, by Ira J. Pitel, Mark Blitshteyn, and Petr Gefter.

FIELD OF THE INVENTION

This invention relates to safety circuitry for disabling circuitry operable on alternate cycles of AC power lines, and more particularly to circuitry for inhibiting unsafe operation of a generator of air ions for neutralizing static charge on work pieces.

BACKGROUND OF THE INVENTION

Many industrial applications require neutralizing of static electrical charges that accumulate on surfaces of work pieces. Semi-conductor fabrication practices commonly introduce static charge neutralizing devices in and about work stations to reduce risk of accumulated static charge causing catastrophic discharge or arcing through and between microscopic layers of integrated circuit components.

In processes for fabricating continuous webs of dielectric materials such as paper or plastic, webs of such materials commonly move at high velocities over rollers and past work stations, and accumulate static surface changes that attract contaminating particulates and inhibit surface-coating processes and packaging into tightly-round rolls.

Static charges on surfaces of such work pieces can be neutralized by supplying ionized air molecules of requisite polarities in appropriate volumes to discharge or neutralize the static surface charges. Remaining surface charge and the polarity thereof may be monitored in conventional manner to feed back control data suitable for altering polarity and quantity of ionized air molecules supplied to the charged work piece to effect substantially complete neutralization of static charge on the work piece. Since both positive and negative air ions may be required to be supplied to a work piece to effect complete neutralization of static charges, if generation of one polarity of air ions fails or is otherwise inhibited, then surface charging rather than charge neutralization may occur, causing unintended catastrophic consequences in the course of attempting to neutralize surface static charge.

SUMMARY OF THE INVENTION

In accordance with the present invention, safety circuitry is introduced into ion-generating circuits that operate during alternate half cycles of alternating power-line voltage. Such safety circuitry disables an ion generator from operating to generate air ions of one polarity in the event of circuit failure of one of the ion generators. In this way, excess ions of one polarity arc inhibited from forming. This ensures that an ionizer for generating neutralizing ions fails safety and is inhibited from functioning as a generator of ions of only one polarity that may otherwise undesirably accumulate and destructively charge a work piece.

DETAILED DESCRIPTION OF THE INVENTION

Figure 1:
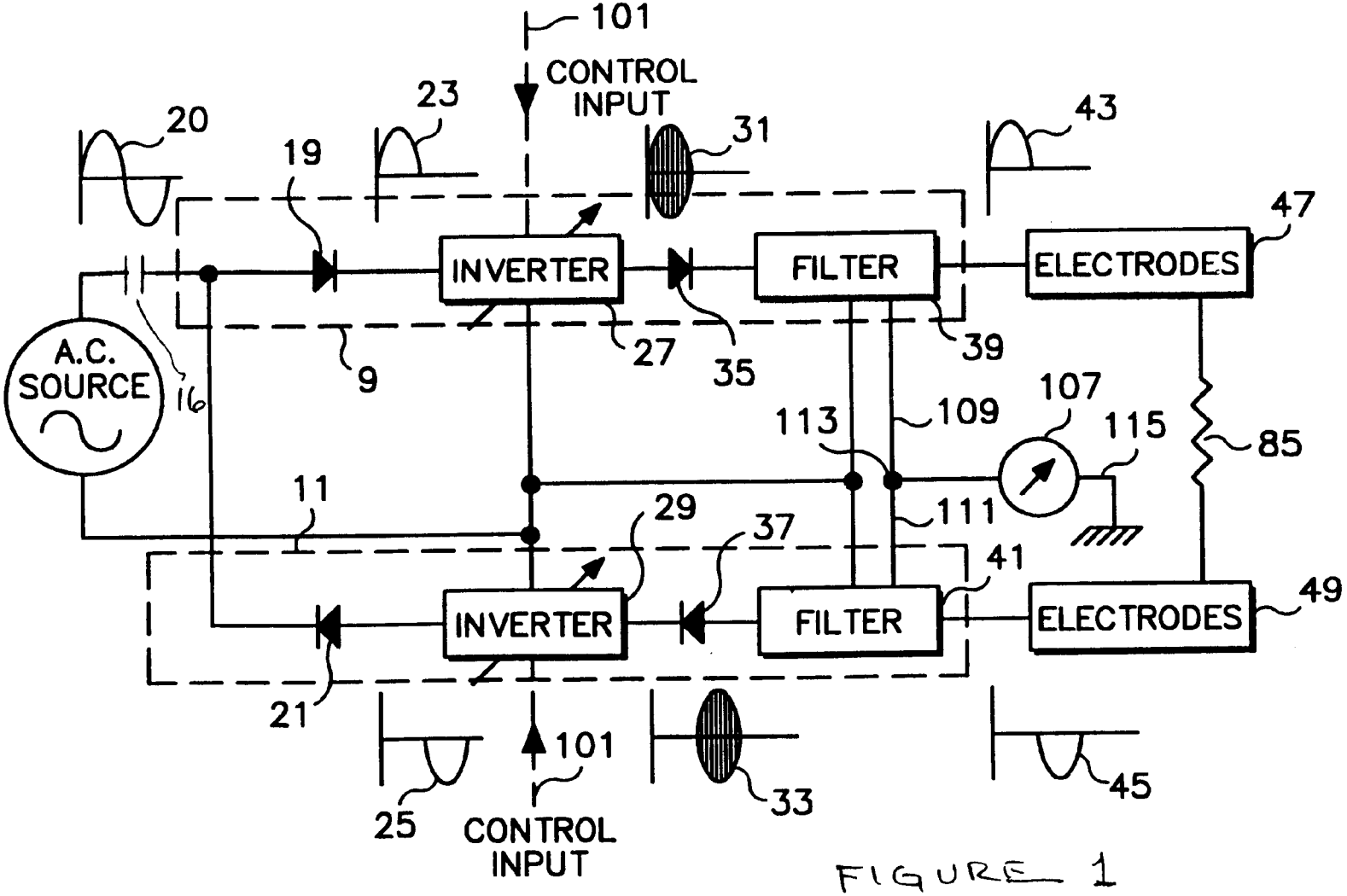
FIG. 1 is a block schematic diagram of a circuit operable on alternate half cycles of power-line supply voltage to produce positive and negative ions.

Referring now to FIG. 1, there is shown a block schematic diagram of generators 9, 11 of positive and negative air ions in which each of the generators 9, 11 receives alternate half waves of applied power (e.g., conventional AC power-line supply) via respective half-wave rectifiers 19, 21. The alternate half-cycles 23, 25 of the applied AC power-line signal 20 thus power the respective inverters 27, 29 to produce oscillations 31, 33 at high frequencies of about 20 kilohertz only during alternate half-cycles of the power-line signal 20. Such high-frequency oscillations at high-voltages of about 3–15 kilovolts are then half-wave rectified by respective diodes 35, 37 to supply the resultant half-wave rectified, high frequency, high voltages to the respective filters 39, 41. These filters smooth out the high-frequency components of the half-wave rectified voltages to produce respective high-voltage outputs 43, 45 that vary over time substantially as the peaks of half-wave rectified, high-frequency signals 31, 33 vary with time. The filtered output voltages 43, 45 are supplied to separate respective sets of ion emitter electrodes 47, 49. The inverters 27, 29 may be controlled in response to applied control signal to vary the effective ionizing potential supplied to respective electrodes 47, 49. However, in the event of circuit malfunction or circuit failure of one of the generators 9, 11 to produce ions of positive or negative polarity while the other of the generators 9, 11 continues to operate, then significant imbalance of generated ions may occur that may statically charge a work piece rather than neutralize any static charge on the work piece. Accordingly, it is desirable to safely inhibit such imbalance operation, preferably without external ion sensors or complex circuitry. To avoid an elaborate and costly scheme to detect a failure in a generator of one polarity and render the generator of opposite polarity non-operational, a simple circuit includes an AC-type capacitor 16 connected at the input to both supplies. Under normal conditions, both power supplies draw approximately equal current during respective half cycles of operation. The large size and low AC impedance of the capacitor limits the AC voltage drop across the capacitor to insignificantly low values during normal operation. If a power supply in one of the two generators of ions of opposite polarities fails, current is drawn during only one half-cycle and the capacitor charges to the peak of the AC line. The combined voltage of the alternate half cycle of power line voltage and the voltage across the capacitor 16, when applied to the power supply of the other ion generator, significantly reduces the voltage applied to such other ion generator, rendering it non-operational.

In practice, the capacitor has to be sufficiently large, typical 500 $\mu$f, with very low voltage ripple attributable to internal resistance. Film or non-polar electrolytic AC capacitors may be used in the embodiment as illustrated in FIG. 1.

Referring now to the circuit diagram of FIG. 2, there is shown another embodiment in which two serially-connected DC electrolytic (polarized) capacitors and a pair of serially-connected diodes form an input network 18 for operation as described later herein. In addition, an input filter network 50 includes a varistor and capacitor for protecting against power-line voltage transients and electromagnetic interference, as the inductor 51 filters high frequency currents produced by the inverters. The AC power at line frequency and at any convenient voltage level (e.g., 24 volts, 120 volts, 220 volts, etc.) is applied via diodes 19, 21 to respective high-frequency inverters 27, 29. Specifically for each inverter, the half-wave rectified power-line AC voltage is filtered 52, 54 for application to high-frequency oscillator 56, 58 that includes voltage step-up transformers 60, 62. The step-up transformer 60, 62 each includes windings connected in respective drain or collector circuits of transistor pairs 68, 70. The step-up transformers include windings coupled to the base or gate circuits of the transistor pair to form regenerative feedback loops that sustain oscillating operation, during conduction of power-line current through the associated diode 19, 21, substantially at a frequency determined by the tank circuit of capacitance 63, 65 and the primary inductance of winding 67, 69. The inductors 57, 59 smooth current flow to the parallel-resonant tank circuits of coils 67, 69 and capacitors 63, 65. Current transformers 64, 66 sample the collector or drain currents of transistor pair 68, 70 to provide a proportional current of reduced magnitude to drive the transistor pair 68, 70. The proportional drive current allows operation over a wide range of input voltages encountered during the half-sinewave variations in each alternate cycle of power-line AC voltage.

The step-up transformer 60, 62 includes an output winding 72, 74 that is connected to a capacitive voltage doubler circuit 76, 78 that produces a rectified high-voltage 43, 45 on output terminal 80, 82 of one or other polarity. The rectified output voltage is filtered via capacitor 84, 86 to provide the output voltage 43, 45 that is applied to the respective ion emitter electrode 47, 49, as illustrated in FIG. 1. The output voltage 43, 45 should be adjusted to such levels relative to each other, or to the system ground, that the electrodes 47, 49 generate positive and negative ion currents of substantially equal magnitude to facilitate balance ionization conditions. A resistor 85 of very high resistance (e.g., 50 megohms) is connected between output terminals to discharge the filter capacitors 84, 86, and resistors of high resistance values (e.g., 20 to 200 megohms) may be serially-connected between output terminals and ion emitter electrodes 47, 49 to limit maximum output current supplied by the voltage doublers 76, 78. The transformers 60, 62, 64, 66 and other components of small size for operation at high frequency promote convenient packaging in a common housing 103 for mounting with the ionizing electrodes 47, 49 near a work piece.

Air ions of one polarity on one of the electrodes 80, 82 and then of opposite polarity on the other of the electrodes 80, 82 are produced during alternate half cycles of applied line signal for neutralizing static charge on a work piece placed near closely-space electrodes 80, 82. In each half cycle, the potential on one electrode is elevated to air ionization levels (e.g., 3–15 kilovolts) while the other electrode is at ground (or zero) potential for establishing high field gradients around the electrodes 80, 82 to promote air ionization. The resistor 85 and the diodes in voltage-doubler circuits 76, 78 are arranged to conduct to ground and thereby provide substantially zero potential on the output and the associated electrode 80, 82 that is inactive during an alternate half cycle.

The return current in the system ground may be is measured across resistor 105 and associated metering circuitry in the system ground return to provide a close measure of the net ionizing current thus generated. When used for neutralizing charge on a work piece, substantially equal numbers of positive and negative ions are generated. In the absence of an external electrostatic field attributable, for example, to a closely-proximate work piece having no electrostatic charge, the ion current from the positive electrode significantly flows to the negative electrode, while the ion current from the negative electrode significantly flows to the positive electrode. Such currents that flow between the electrodes of opposite polarities produce a net zero current in the system ground return. However, if, for example, the work piece carries a negative electrostatic charge, its electrostatic field attracts the ions from positive electrodes. As the result, positive ion current flows to the work piece to neutralize its surface charge, while the ion current from the negative electrode significantly flows to the positive electrode or back to the negative electrode during the inactive half cycles. The current in the system ground return thus changes from zero to the value directly related to the ion current that flows to the surface of the charged work piece. The system ground return current may thus be used to monitor the polarity and magnitude of the net ionizing current. Self-regulation of charge neutralization on a work piece may be enhanced by active control of one or other of the generators 9, 11 in response, for example, to the signal at terminal 99 that is representative of the system ground net current. As illustrated in FIG. 2, the circuit produces a control signal 99 that may be applied to one or both of the generators 9, 11 to alter the ionizing potential of the output voltages produced thereby. For instance, a signal in the ground return indicating the net positive ion current going to a charged work piece may be used to decrease the supply voltage to the negative ion generator, and thus reduce the ionizing voltage on the negative ionizing electrode. However, such self-regulation is incapable of fail safe operation in the event one or other of the positive and negative ion generators 9, 11 exhibits a circuit malfunction while the other of such generators continues operating.

Figure 2:
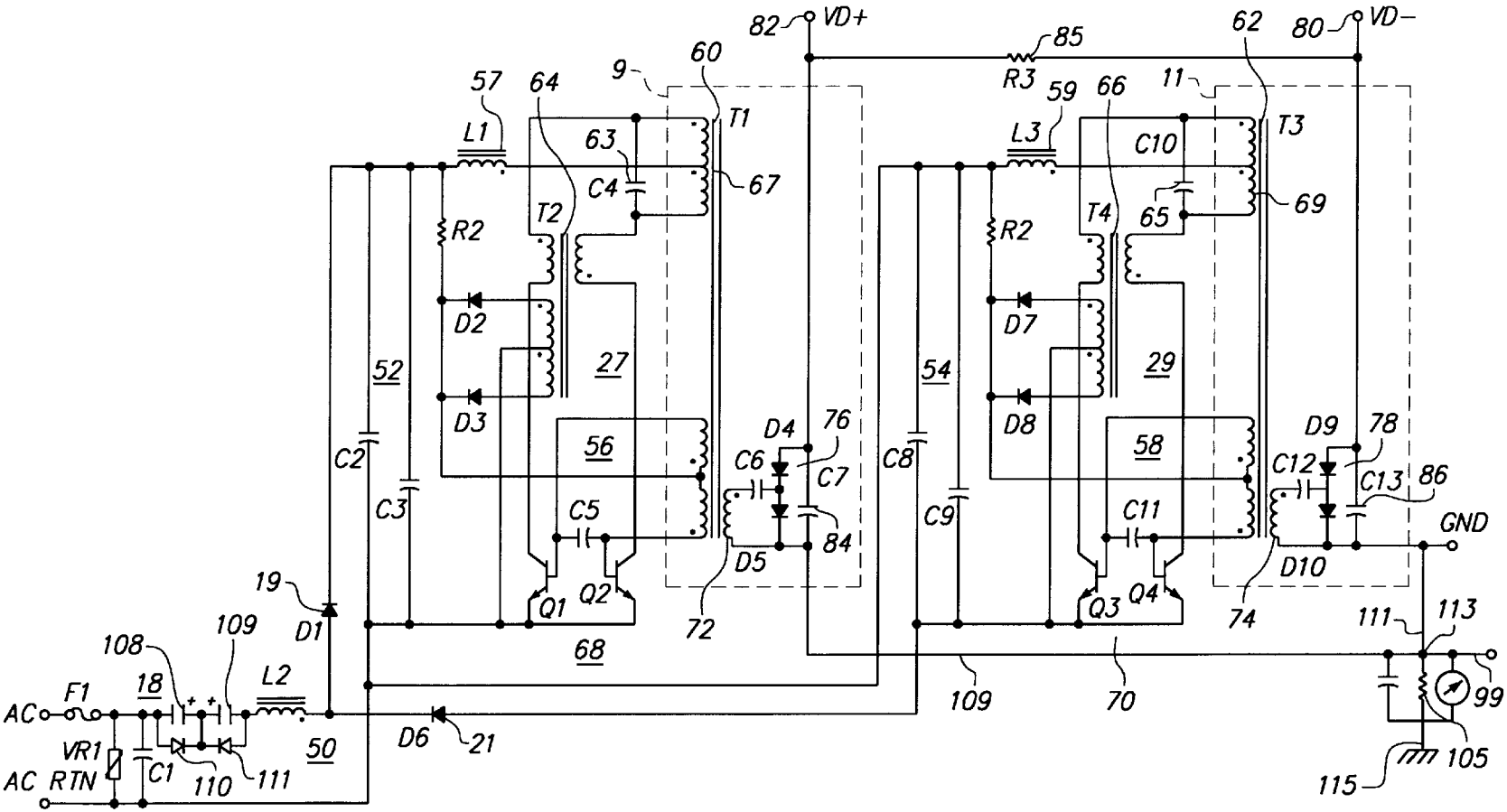
FIG. 2 is a schematic diagram of the circuit of FIG. 1 including safety circuitry according to the present invention.

In accordance with the present invention, the diode-capacitor input network 18 according to the embodiment illustrated in FIG. 2 is connected in the supply-line effectively to reduce automatically the voltage supplied to one ion generator that remains operational under conditions of circuit failure or malfunction in the other ion generator in order to inhibit further operation of the functioning ion generator. Specifically, a single large-value AC capacitor 16, as illustrated in FIG. 1, is replaced by two DC (polarized) capacitors and diodes that are connected as shown to conduct supply-line current in one direction during one half cycle though the series combination of one of the diodes and capacitors, and then to conduct supply-line current in the opposite direction during the alternate half cycle through the series combination of the other of the diodes and capacitors. This charges the capacitors in opposite polarity orientations, as shown, during normal operation of the positive and negative ion generators 9, 11 to yield a resultant steady-state voltage drop across the series combination of capacitors that is essentially zero (or negligible). The diode-capacitor input network 18 thus has essentially no effect upon normal circuit operation.

However, if, for instance, generator 9 fails to operate normally to produce quantities of air ions of the associated polarity, then the current drawn during the half cycle of supply-line voltage during which such failed generator should operate will be diminished. The capacitor 109 that is serially connected with the diode 110 which is conductive in such half cycle will charge to the peak of the line voltage. During the alternate half cycle of supply-line voltage during which the operational generator 11 may operate normally, the voltage drop across the capacitor 109 inhibits conduction by the diode 111 that is poled for conduction in such half cycle for a major portion of such half cycle, with a resultant lower average voltage supplies to the normally operational generator 11. As a result, ion generation by the one normally operational generator 11 is significantly reduced or eliminated for fail-safe response to circuit failure or circuit malfunction in the other ion generator 9. Similar fail-safe response occurs upon failure of the other ion generator 11.

Such capacitors may each be conventional bi-polar electrolytic or film-insulated capacitors of, for example, about 100 volt ratings and 470 $\mu$ farads capacitance for operation on the supply-line alternating voltage.

Therefore, the circuit of the present invention provides fail safe protection against circuit malfunction of one of a pair of generators of air ions of positive and negative polarity by diminishing the net average voltage applied to the remaining one of the pair of generators in response to and malfunction of the other of the pair of generators.

What is claimed is:

1. A method for providing fail-safe operation of an air ionizer operable to produce positive and negative air ions on respective alternate half cycles of alternating power-line signal, the method comprising:

serially connecting a capacitive element to conduct alternating power-line current therethrough to the air ionizer during normal operation of the air ionizer on respective alternate half cycles, and for storing charge therein of one polarity under conditions of circuit malfunction of the air ionizer to produce one of positive and negative air ions, said one polarity being opposed to polarity of an alternate half cycle of power-line signal during which the air ionizer produces the other of positive and negative air ions for inhibiting production of said other positive and negative air ions.

2. The method according to claim 1 wherein connecting the capacitive element includes serially connecting a pair of capacitors, and shunting the serially-connected pair of capacitors with serially-connected diodes poled in opposite directions of conductivity with common connections of serially-connected diodes and serially-connected capacitors connected together.

3. Apparatus for controlling operation of a pair of circuits which produce a combined utilizable output having selected electrical parameters under normal operation on an alternating signal applied thereto, the apparatus comprising a first circuit in the pair of circuits which operates on a positive half-cycle of the alternating signal applied thereto in order to produce a portion of the combined utilizable output;

a second circuit in the pair of circuits which operates on a second and opposite half-cycle of the alternating signal applied thereto in order to produce another portion of the combined utilizable output; and circuitry including a pair of serially coupled capacitors and a pair of diodes serially connected in polarity opposition in parallel with the serially coupled pair of capacitors, with junctions of the serially coupled capacitors and the serially connected diodes coupled together for providing the alternating signal to the pair of circuits to operate the first circuit normally on current drawn thereby during the positive half-cycle of the alternating signal and to operate the second circuit normally on current drawn thereby during the second and opposite half-cycle of the alternating signal, said circuitry inhibiting the drawing of current by either one of the first and second circuits in response to failure of the other of the first and second circuits to draw current during abnormal operation.

4. Apparatus according to claim 3 wherein the first circuit is a generator of air ions of one polarity, and the second circuit is a generator of air ions of opposite polarity.

* * * * *